US005361510A

United States Patent [19]

Cox

[11] Patent Number: 5,361,510

[45] Date of Patent: Nov. 8, 1994

[54] PICTURE FRAME HANGING WIRE APPLICATOR TOOL

[76] Inventor: John W. Cox, 1803 Edelweiss Cir., Sandy, Utah 84092

[21] Appl. No.: 122,150

[22] Filed: Sep. 16, 1993

[51] Int. Cl.[5] ..... G01B 3/00

[52] U.S. Cl. ..... 33/613; 33/42; 33/481; 33/485; 33/1 LE

[58] Field of Search ..... 33/1 LE, 613, 562, 474, 33/481, 484, 485, 429, 479, 732, 42, 44; 40/153, 657

[56] References Cited

U.S. PATENT DOCUMENTS

| | | | |
|---|---|---|---|
| 848,399 | 3/1907 | Rowell | 33/42 |
| 4,241,510 | 12/1980 | Radecki . | |
| 4,382,337 | 5/1983 | Bendick | 33/613 X |
| 4,393,600 | 7/1983 | Coe | 33/474 |
| 4,455,756 | 6/1984 | Greene . | |
| 5,103,573 | 4/1992 | Ealing et al. | 33/613 |
| 5,109,611 | 5/1992 | Houck | 33/613 |

*Primary Examiner*—William A. Cuchlinski, Jr.
*Assistant Examiner*—Alvin Wirthlin
*Attorney, Agent, or Firm*—John R. Flanagan

[57] ABSTRACT

A picture frame hanging wire applicator tool includes an elongated body member, an end member attached to and projecting transversely from an end of the body member for holding the body member in relation to a top edge of a picture frame, and a series of longitudinally-spaced apart protuberances in the form of pegs carried along a front side of the body member. Each of the pegs carried by the body member provides a means for retaining a picture frame hanging wire at an apex point which is at a known distance from the top edge of the picture frame. Indicia labels can be provided on the back side of the frame for recording the distance between the hanging wire apex point and the top edge of the picture frame for use by the end user or person who later will hang the picture frame at a desired location on a wall.

12 Claims, 1 Drawing Sheet

PICTURE FRAME HANGING WIRE APPLICATOR TOOL

BACKGROUND OF THE INVENTION

1. Field of the Invention

The present invention generally relates to aids for assisting in hanging picture frames at desired locations and, more particularly, is concerned with a picture frame hanging wire applicator tool operable to string the hanging wire at a known position on the back side of the picture frame.

2. Description of the Prior Art

Many picture frame hanging aids are known in the prior art. Most prior art picture frame hanging devices typically employ some means for aiding an end user who desires to hang a picture frame having a hanging wire at a desired location on a wall. Representative of the prior art picture frame hanging devices are the ones disclosed in U.S. Pat. Nos. to Radecki (4,241,510), Greene (4,455,756), Ehling et al (5,103,573) and Houck (5,109,611).

Generally speaking, each of these prior art devices are to be employed by the end user hanging the picture frame and have means to assist that person in placing the picture frame at a desired location. For instance, some of the devices, such as those of the Radecki and Ehling et al patents, have scales and levelers of various configurations for positioning wall hooks or nails, while other of the devices, such as those of the Greene and Houck patents, have means for holding a picture frame in place on the wall while a fastener position is marked or established.

Although these prior art devices probably function as intended, they all share a common drawback. It is the end user, not the picture frame maker, who must purchase the device in order to use it since it is the end user and not the picture frame maker who actually hangs the picture frame on the wall. Thus, the end user is required to purchase one of these special-purpose, limited-use devices in order to accurately locate the position of the picture frame to be hung on the wall.

Consequently, a need exists for a tool which would be used by the picture frame maker, rather than the end user, to accurately position the hanging wire on the back side of the picture frame so that the end user can be informed of the position of the wire and take such information into account when placing the picture frame on the wall.

SUMMARY OF THE INVENTION

The present invention provides a picture frame hanging wire applicator tool designed to satisfy the aforementioned needs. The applicator tool of the present invention is used to assist a picture frame maker or framer in accurately locating, stringing and measuring a hanging wire on a picture frame so that the picture frame may be subsequently positioned on a wall at a predetermined location by an end user without the use of special purpose tools.

The applicator tool of the present invention is a simple, compact device that is easy to use for precisely positioning a hanging wire on a picture frame. The applicator tool permits the picture frame maker (or the framer) to precisely string the wire on the back side of the picture frame and then to record the resulting position of a fastener to be used by the end user in conjunction with the wire on the back side of the picture frame.

Accordingly, the present invention is directed to a picture frame hanging wire applicator tool which comprises a body member and an end member. The end member is attached to, and projects outwardly in a transverse relation from, the body member for holding the body member along and against a back side of the picture frame relative to a top edge thereof.

The applicator tool also comprises positioning means in the form of a series of protuberances, such as pegs, connected to an outer or front side of the body member. The protuberances are longitudinally spaced from one another along the body member and project outwardly therefrom for holding the hanging wire for the picture frame under a state of tension at a point thereon intermediate between the opposite ends of the wire and at a known distance from the top edge of the picture frame.

More particularly, the body member has a straight, flat configuration, The end member projects at a substantially right angle from one end of the body member. The body member has an inner or rear side disposed adjacent to the end member which is opposite from the outer or front side of the body member upon which the series of protuberances are formed and from which they project. The end member has a lower side disposed adjacent to the body member and an opposite upper side. The protuberances are placed at known and marked distances from the lower side of the end member.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
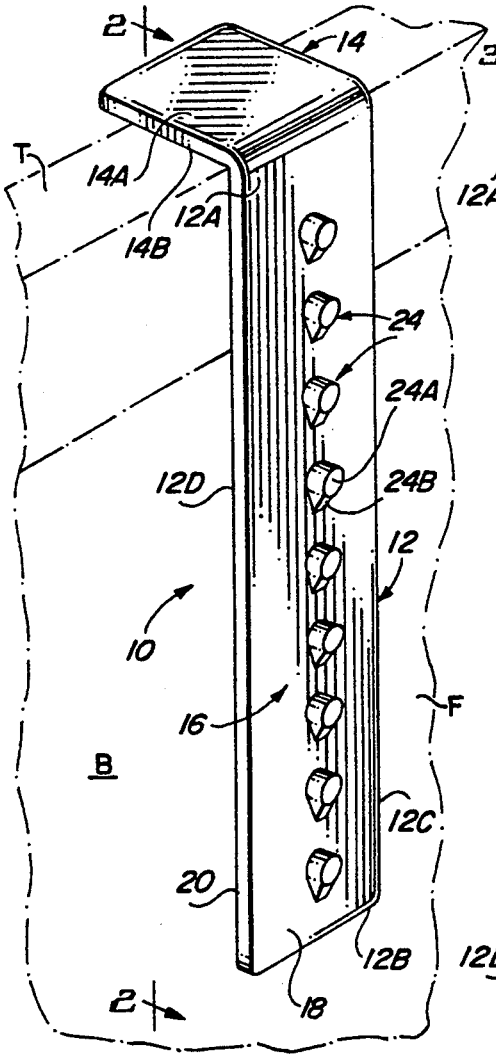
FIG. 1 is a perspective view of the picture frame hanging wire applicator tool shown relative to an upper edge of a picture frame.
Figure 2:
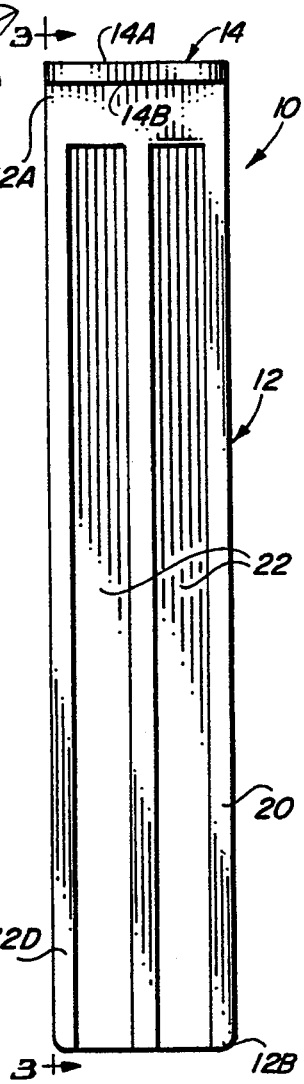
FIG. 2 is an enlarged rear elevational view of the applicator tool of FIG. 1 as seen along line 2—2 of FIGS. 1 and 3.
Figure 6:
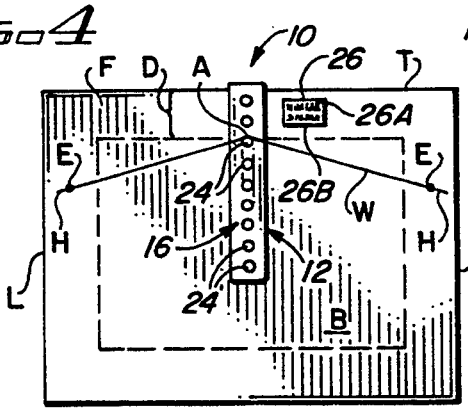
FIG. 6 is a front elevational view of the applicator tool shown positioned on a picture frame with a hanging wire extending across one of stringing pegs.

Referring to the drawings and particularly to FIGS. 1 and 6, there is illustrated a picture frame hanging wire applicator tool, generally designated 10, of the present invention, which hereinafter will be referred to as the applicator tool 10. The applicator tool 10 is shown in the orientation it is placed relative to the picture frame F during normal use. The applicator tool 10 engages an apex point A on the hanging wire W at a predetermined distance below a top edge T of the picture frame F. The term "picture frame" as used hereinafter is meant in a generic sense to include any type of mounting frame. The term "wire" as used hereinafter is meant in a generic sense to include any type of flexible member, such as a wire, string or cord, to mount the picture frame from the wall.

Basically, the applicator tool 10 includes a body member 12, an end member 14 and hanging wire supporting means 16. The body member 12 of the tool 10 has an elongated substantially flat straight configuration. Relative to its orientation when placed against the back B of the picture frame F, the body member 12 has a pair of opposite upper and lower ends 12A, 12B and a pair of front and rear sides 12C, 12D. The front and rear sides 12C, 12D are defined by substantially parallel outer and inner flat surfaces 18, 20 which respectively face away from and toward the back B of the picture frame F. A pair of longitudinally extending channels 22 are recessed in the inner surface 20 at the rear side 12D of the body member 12 for stiffening the structure of the body member 12.

Figure 7:
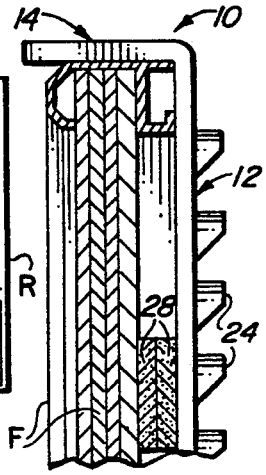
FIG. 7 is an enlarged fragmentary side elevational view of the applicator tool shown positioned on metal picture frame being shown in section with spacers disposed between the picture frame and tool.

The end member 14 of the tool 10 is attached to the upper end 12A of the body member 12 and projects in a generally transverse relation outwardly therefrom. The end member 14 is adapted to overlie the top edge T of the picture frame F and thereby suspend the body member 12 downwardly along and against the back B of the picture frame F. Like the body member 12, the end member 14 also has a substantially flat straight configuration. However, it is substantially shorter in length than the body member 12. Preferably, the end member 14 projects at a substantially right, or ninety degree, angle from the upper end 12A of body member 12. Thus, the flat body member 12 and flat end member 14 lie in respective planes which intersect one another at a substantially right, or ninety degree, angle. The end member 14 is disposed adjacent to and extends from the rear side 12D of the body member 12 in a direction opposite from the direction faced by the front side 12C of the body member 12. The end member 14 has a pair of opposite upper and lower sides 14A, 14B. The lower side 14B is disposed adjacent to the rear side 12D of the body member 12 and overlies and rests upon the top edge T of the picture frame F when the tool 10 is placed in its normal position of use thereon, as seen in FIGS. 1, 6 and 7.

Preferably, the body and end members 12, 14 of the tool 10 are integrally connected together. The tool 10 can be made from any suitable material such as a metal or plastic by using conventional fabrication techniques.

Figure 3:
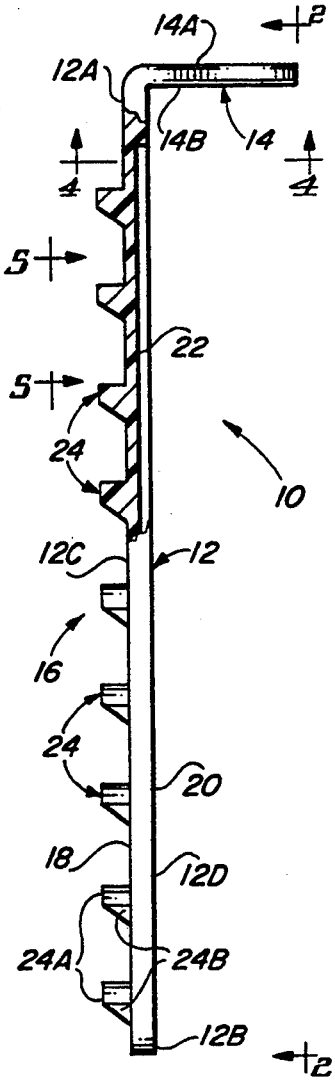
FIG. 3 is a side elevational view, with portions broken away and sectioned, of the applicator tool as seen along line 3—3 of FIG. 2.
Figure 4:
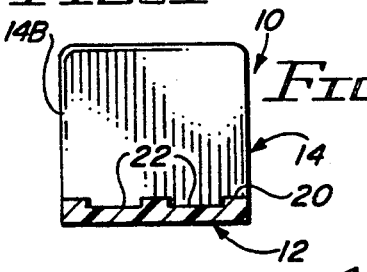
FIG. 4 is a sectional view of the applicator tool taken along line 4—4 of FIG. 3.
Figure 5:
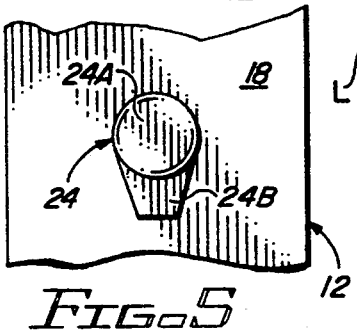
FIG. 5 is an enlarged fragmentary front elevational view of the applicator tool as seen along line 5—5 of FIG. 3, showing one of the stringing pegs of the tool.

The hanging wire supporting means 16 of the tool 10 which supports the hanging wire W at its apex point A during its installation on the picture frame F takes the form of a plurality or series of protrusions or protuberances 24. As seen in FIG. 3, the protuberances 24 are fixedly connected to and project outwardly from the front side 12A or outer flat surface 18 of the body member 12 so as to define a plurality of spaced stationary positions thereon. The protuberances 24, and thus the positions defined thereby, are spaced apart longitudinally or vertically from one another and from the top edge T of the picture frame F through known distances. The spaced protruberances 24, which resemble pegs, project outwardly from the outer surface 18 of the body member 12 for holding the hanging wire W under a state of tension at its apex point A being located a known distance from the lower side 14B of the end member 14 of the tool 10 and thus from the top edge T of the picture frame F, as wire W is being installed on the picture frame F. The apex point A typically is located midway or intermediately between opposite ends E of the wire W which are the portions on the wire W which are attached to the picture frame F.

Referring to FIGS. 1, 3, 5 and 7, in one exemplary embodiment, each protuberance or peg 24 has an upper body portion 24A and a lower tail portion 24B. The upper body portion 24A has a cylindrical shape while the lower tail portion 24B has a trapezoidal shape and is oriented in a downwardly and inwardly sloping relation from the upper body portion 24A. Each protrusion 24 can just as readily have other configurations as well. The configuration of the peg 24 permits the hanging wire W to be easily pulled up and over the peg 24 and further permits a framer to insert the tool 10 down and in between the hanging wire W and picture frame F without the tool catching on the wire W.

As mentioned previously, the protuberances 24 are disposed at known distances from one another and from the lower side 14B of the end member 14 of the tool 10. Also provided as part of the tool 10 is a label 26 having a back adhesive surface 26A and a front writing surface 26B. The label 26 is affixed at its back adhesive surface 26A to the picture frame F and its front writing surface 26B is used for recording thereon the known distance of the wire apex point A from the top edge T of the picture frame F.

Referring to FIG. 6, there is illustrated the applicator tool 10 in use in relation to the picture frame F. The applicator tool 10 is positioned in a vertical relation to the back B of the picture frame F. The lower surface 14B of the end member 14 is in contact with the top edge T of the picture frame F, and the inner surface 20 of the body member 12 is in contact with the back B of the picture frame F. Also, the applicator tool 10 is substantially centered in relation to the top edge E of the picture frame F.

The framer would begin installation of the hanging wire W to the picture frame F by securing the hanging wire W at either end, for example the left, end E thereof to a starting point, which can be defined by a hook H, located on the left side edge L of the picture frame F. Next, the framer strings the picture frame hanging wire W over and across a selected one of the pegs 24 such that the wire W at its apex point A rests thereon. Then, the framer secures the right end E of the wire W at the opposite end point, which can be defined by another hook H, located on the right side edge R of the picture frame F. The hanging wire W is thus strung with sufficient tension to maintain tautness across the peg 24 at the apex point A of the wire W. Since the distance of the selected peg 24 from the lower surface 14B of the end member 14 of the tool 10 is known, the distance of the apex point A of the wire W from the top edge T of the picture frame F is also known. This known distance D can be written by the framer on the back surface B of frame F on the indicia label 26. The framer can now remove the tool 10 by pulling the hanging wire W away for the outer surface 10 of the body member 12 and pulling the tool 10 out from under the wire W. The person who will eventually hang the picture frame F can read the distance D written on the label 26 to properly position the picture frame on a wall.

Referring to FIG. 7, there is illustrated the applicator tool 10 being use on a metal frame F of the type having a recessed back. Here, the applicator tool 10 is used in combination with spacers 28 to maintain a parallel orientation with the picture frame F.

It is thought that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

I claim:

1. An applicator tool for stringing a hanging wire on a picture frame with an apex of the wire at a predetermined distance below a top edge of the picture frame, said applicator comprising:

(a) an elongated straight flat body member having a pair of opposite ends and a pair of opposite front and rear flat surfaces;

(b) means for resting said body member against the back of the picture frame including an end member being attached to, and projecting in a transverse relation rearwardly outwardly from, said body member, said end member being adapted to rest on the top edge of the picture frame to suspend said body member downwardly along and against a back side of the picture frame relative to the top edge thereof; and (c) means for supporting an apex of the hanging wire including a plurality of protuberances spaced apart from one another and being fixedly connected directly to, and projecting forwardly outwardly from, said front flat surface of said body member at different known distances from said end member so as to define a plurality of positions between said opposite ends of said body member to support an apex of the hanging wire along said front flat surface of said body member being spaced apart from one another and from the top edge of the picture frame by the different known distances.

2. The tool of claim 1 wherein said protuberances are a series of pegs fixedly connected to said front flat surface of said body member.

3. The tool of claim 2 wherein each of said pegs has an upper cylindrically-shaped body portion and a lower trapezoidally-shaped tail portion being oriented in a downwardly and inwardly sloping relation from said body portion so as to permit the hanging wire to be pulled in an upward direction past said peg without catching on said tail portion thereof.

4. The tool of claim 1 wherein said front and rear flat surfaces of said body member extend substantially parallel to one another.

5. The tool of claim 1 wherein said end member projects at a substantially right angle from one of said opposite ends of said body member.

6. The tool of claim 1 wherein said end member is disposed adjacent to said rear flat surface of said body member and opposite from said front flat surface thereof.

7. The tool of claim 1 wherein said end member has a lower flat surface disposed adjacent to said rear flat surface of said body member.

8. An applicator tool for stringing a hanging wire on a picture frame with an apex of the wire at a predetermined distance below a top edge of the picture frame, said applicator comprising:

(a) an elongated substantially flat straight body member having a pair of opposite ends and a pair of opposite front and rear flat surfaces which extend parallel to one another, said body member lying in a first plane;

(b) a substantially flat straight end member being attached to, and projecting in a transverse relation outwardly from, one of said opposite ends of said body member, said end member being adapted to rest on the top edge of the picture frame to suspend said body member downwardly along and against a back side of the picture frame relative to the top edge thereof, said end member lying in a second plane which intersects said first plane at about a ninety degree angle; and (c) a series of spaced protuberances fixedly connected to said front flat surface of said body member and projecting outwardly therefrom, said protuberances defining a plurality of positions thereon being spaced apart from one another and from the end member by different known distances to support an apex of the hanging wire at a selected one of said positions;

(d) said protuberances being a series of pegs fixedly connected to said front flat surfaces of said body member, each of said pegs having an upper body portion extending rearwardly outwardly from said front flat surface and a lower tail portion being oriented in a downwardly and inwardly sloping relation from said upper body portion so as to permit the hanging wire to be pulled in an upward direction past said peg without catching on said lower tail portion thereof.

9. The tool of claim 8 wherein said body portion of each of said pegs is cylindrically-shaped and said tail portion of each of said pegs is trapezoidally-shaped.

10. The tool of claim 8 wherein said end member is disposed adjacent to said rear flat surface of said body body member and opposite from said front flat surface thereof.

11. The tool of claim 10 wherein said end member has a lower flat surface disposed adjacent to said rear flat surface of said body member.

12. The tool of claim 11 wherein said protuberances connected to said front flat surface of said body member are disposed at known and marked distances from said lower flat surface of said end member.

* * * * *